US007156392B2

(12) United States Patent
Plein

(10) Patent No.: US 7,156,392 B2
(45) Date of Patent: Jan. 2, 2007

(54) POLYHEDRAL PUZZLE

(76) Inventor: Virginia H. Plein, 602 S. Ballas Rd., Kirkwood, MO (US) 63122

( * ) Notice: Subject to any disclaimer, the term of this patent is extended or adjusted under 35 U.S.C. 154(b) by 24 days.

(21) Appl. No.: 11/028,440

(22) Filed: Jan. 3, 2005

(65) Prior Publication Data

US 2006/0145418 A1 Jul. 6, 2006

(51) Int. Cl.
*A63F 9/08* (2006.01)

(52) U.S. Cl. ..... 273/156; 446/122

(58) Field of Classification Search ..... 273/153 R, 273/156; 446/122, 123, 104, 115
See application file for complete search history.

(56) References Cited

U.S. PATENT DOCUMENTS 3,271,895 A * 9/1966 Sphirensen ..... 446/104
4,055,019 A * 10/1977 Harvey ..... 446/115
5,472,365 A * 12/1995 Engel ..... 446/104
5,938,497 A * 8/1999 Mott ..... 446/122
6,411,073 B1 * 6/2002 Fischer et al. ..... 324/66
6,558,065 B1 * 5/2003 Huang ..... 403/170

* cited by examiner

*Primary Examiner*—Steven Wong
(74) *Attorney, Agent, or Firm*—Charles C. McCloskey

(57) ABSTRACT

A polyhedral puzzle has basic pieces that connect and form polyhedrons. The present invention serves as a puzzle solved by the geometric relationship between the pieces. The pieces have four triangular members and each member has a primary and a secondary form. The members connect with positioners interlocking with notches on adjacent members. The positioners include slots that allow members to connect at three angles with each other. A primary member connects to a secondary member in an alternating fashion. The members assemble into polyhedrons such as a cube, sphere, cylinder, or combination thereof that lead to sculptures, including humanoid forms, at various scales or buildings at larger scales.

9 Claims, 9 Drawing Sheets

POLYHEDRAL PUZZLE

BACKGROUND OF THE INVENTION

The polyhedral puzzle relates generally to toys and models and more specifically to pieces that assemble into geometric shapes or combinations of shapes.

People play with toys and assemble models from pieces of all kinds. Play and assembly both entertain and develop coordination. Starting with a basic piece, such as a block, forms take shape from the basic pieces. Using imagination, a person can form many objects like a cube, a sphere, and perhaps a sculpture. A basic piece has features that allow one piece to connect with another piece. Using a quantity of pieces, pieces connect with one another to make an object desired by a person. Basic pieces have seen use both indoors and outdoors.

Traditionally, people have assembled basic pieces into a wide variety of objects. A person gathers pieces from a container then assembles them following an instruction sheet and occasionally improvising a shape or from the pieces and the person's imagination.

DESCRIPTION OF THE PRIOR ART

The prior art has many versions of basic pieces that assemble into objects approaching a polyhedron. Lincoln Logs® had cylinders colored like wood with notched ends. The logs assembled into frontier houses and other generally rectangular structures. Tinker Toys® connected rods with disk like joints. Rods attained many angles, forming polyhedrons of large diameter and open skin. Lego® bricks had a brick like shape with buttons and matching sockets. The bricks and their accessories interlocked to form structures and buildings of all kinds but less so for polyhedrons.

The present invention overcomes the difficulties of rectangular structures and ribbed open shapes by positioning a class of basic pieces well suited to forming polyhedrons and combinations of polyhedrons.

SUMMARY OF THE INVENTION

Generally, the present invention provides a class of basic pieces that connect at certain angles to form polyhedrons, particularly spherical ones. The present invention serves as a puzzle solved by the geometric relationship between the pieces. The class of pieces has five members and each member has a primary and a secondary form. The members are triangles at certain angles and lengths. The members connect with positioners interlocking with notches on adjacent members. The primary forms of the members have two positioners on included sides of a member with a notch on the third side. The secondary forms of the members have two notches on the included sides of a member but with a positioner on the third side. The positioners include slots that allow members to connect at three angles with each other. A primary member connects to a secondary member in an alternating fashion.

With sufficient quantity of members, the members assemble into polyhedrons such as a cube, dodecahedron or sphere, cylinder, or combination thereof. Shape combinations may lead to sculptures, including humanoid forms, at various scales. At room scale or larger, the members assembled into a shape that may require reinforcement such as beams and columns of ordinary construction methods.

There has thus been outlined, rather broadly, the more important features of the invention in order that the detailed description thereof that follows may be better understood and that the present contribution to the art may be better appreciated. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved polyhedral puzzle.

Another object is to provide such a polyhedral puzzle that has members that engage each other to form spherical, cube, and combination shapes.

Another object is to provide such a polyhedral puzzle that is portable and suitable for both indoor and outdoor use.

Another object is to provide such a polyhedral puzzle that has edge conditions to minimize injury to people.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1A:
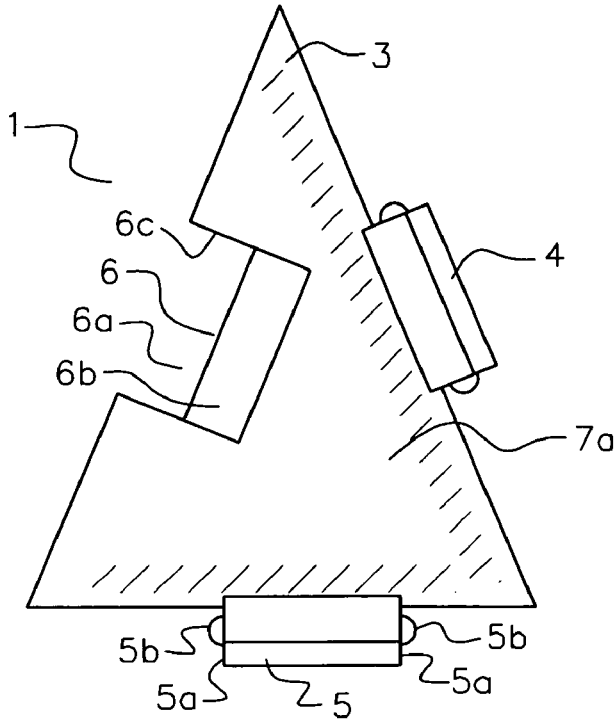
FIG. 1*a* shows a top view of member A in primary form as constructed in accordance with the principles of the present invention.

The present art overcomes the prior art limitations by providing a puzzle with multiple members in two forms that assemble into spherical and cubic shapes both by plan and by improvisation. Beginning on FIG. 1*a*, a polyhedral puzzle has members 1 that engage one another. FIG. 1*a* shows the primary form 7*a* of Member A denoted by two connecting means 4 or positioners 5. Member A has the shape of an isosceles triangle with the included angle 3 of 45° between the equal length sides. Upon one equi-length side, Member A has a positioner 5 generally centered and on the other equi-length side, Member A has an indent 6. Opposite the included angle 3, Member A has a second positioner 5 thus denoting the primary form 7*a*. With an included angle 3 of 45°, the isosceles triangle of Member A has two other angles at 67.5°. The short side of Member A is opposite the included angle 3 and the long equal sides flank the included angle 3. The offset 9 of Members A, B, C, and D are proportional to the thickness 2 of the Member.

The equal length sides of Member A have an edge condition as a pointed bevel that engages a positioner 5 and the Member A corners are rounded over to prevent injury to a puzzle assembler. A pointed bevel refers to rounding over of the top and bottom edges of a side where the rounding meets in the center of the thickness of a side as a line. The side with the indent 6 is rounded over in a generally circular form from top edge to bottom edge without a line at the center. The description of a pointed bevel and rounded over sides of indents for Member A applies to both primary 7*a*, 7*b*, 7*c*, 7*d*, 7*e* and secondary forms 8*a*, 8*b*, 8*c*, 8*d*, 8*e* of Members A, B, C, D and E.

Figure 1B:
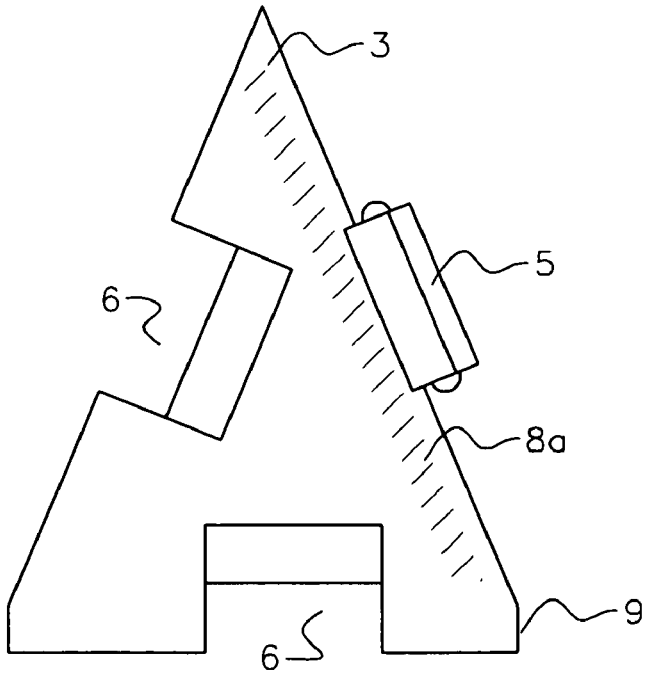
FIG. 1*b* shows a top view of member A in secondary form as constructed in accordance with the principles of the present invention.

Then in FIG. 1*b*, Member A has a secondary form 8*a* shown by two indents 6. The secondary form 8*a* is also an isosceles triangle with a 45° included angle 3 and two equal length sides as in the primary form 7*a*. One indent 6 is located opposite the included angle 3 and the second indent 6 is located upon an equi-length side. One positioner 5 is located generally centered upon the other equi-length sides thus showing the secondary form 8*a*. The side of Member A in secondary form 8*a* with the positioner 5 has a pointed bevel and the remaining two sides are rounded over. Opposite the included angle 3, both corners are blunted or offset to fit Member A secondary form 8*a* with other pieces 1. The offset 9 typically has a length similar to the thickness 2 of the piece 1. This description of blunting applies to Members A, B, C, D, and E.

Figure 2A:
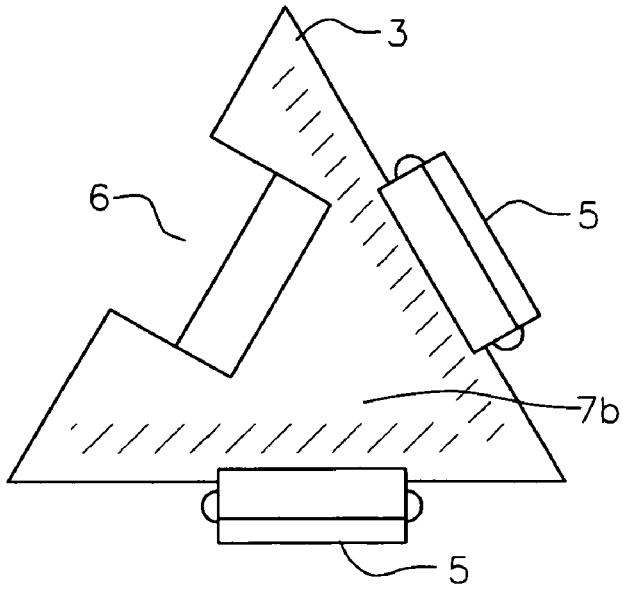
FIG. 2*a* shows a top view of member B in primary form for the present invention.

In FIG. 2*a*, the primary form 7*b* of Member B appears as a generally equilateral triangle with two positioners 5. The sides of Member B have the same length here. Member B has three included angles 3 of 60°. Upon two sides, Member B has a positioner 5 generally centered and on the remaining side, Member B has an indent 6. The sides of Member B with a positioner 5 have a pointed bevel that engages another positioner 5, the remaining side is rounded over, and the corners of Member B have a dulled point. The sides of Member B have the same length as the short side of Member A to connect with Members 7*a*, 7*b*, 8*a*, 8*b*.

Figure 2B:
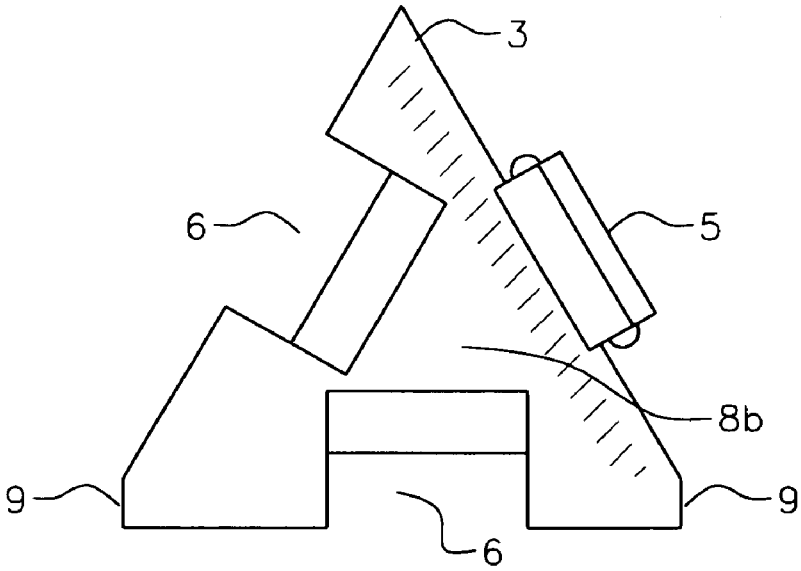
FIG. 2*b* shows a top view of member B in secondary form for the present invention.

Then in FIG. 2*b*, Member B has a secondary form 8*b* shown by two indents 6 on two sides of a generally equilateral triangle. On the remaining side, Member B has one positioner 5, typical of a secondary form 8. The indents 6 and positioner 5 are generally centered upon their sides. Two corners of Member B are truncated, or offset 9 in the secondary form 8, one corner opposite the positioner 5 and the other corner adjacent to the positioner 5. The side with a positioner 5 has a pointed bevel and the remaining sides are rounded over.

Figure 3A:
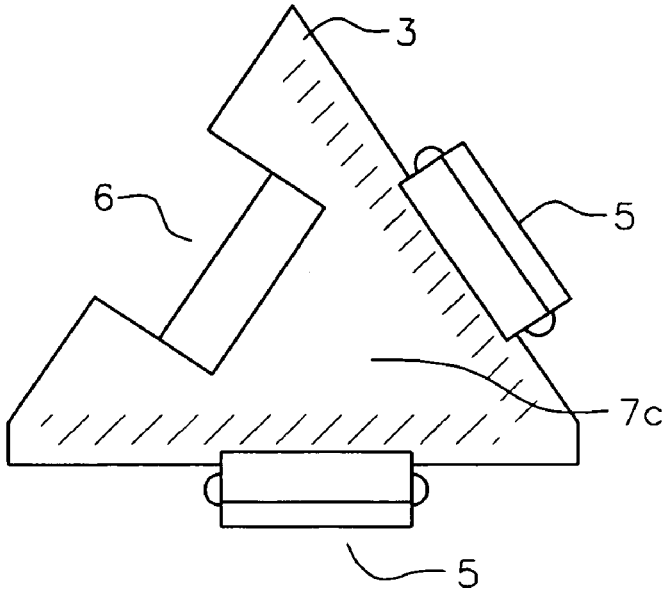
FIG. 3*a* shows a top view of member C in primary form for the present invention.

Moving to the next piece, FIG. 3*a* shows the primary form 7*c* of Member C as a generally equilateral triangle with two positioners 5. More particularly, Member C has three sides with the same effective length. The effective length arises upon blunting or truncating two corners of the triangular shape. The sides of Member C connect with all sides of Member B and the short side of Member A. In Member C, the included angle 3 is 67.5° and the two corners opposite the included angle are blunted. Further, the blunts flank a positioner 5. As before, the sides of Member C with a blunt have a pointed bevel that engages a positioner 5 and the side with an indent 6 has a rounded edge.

Figure 3B:
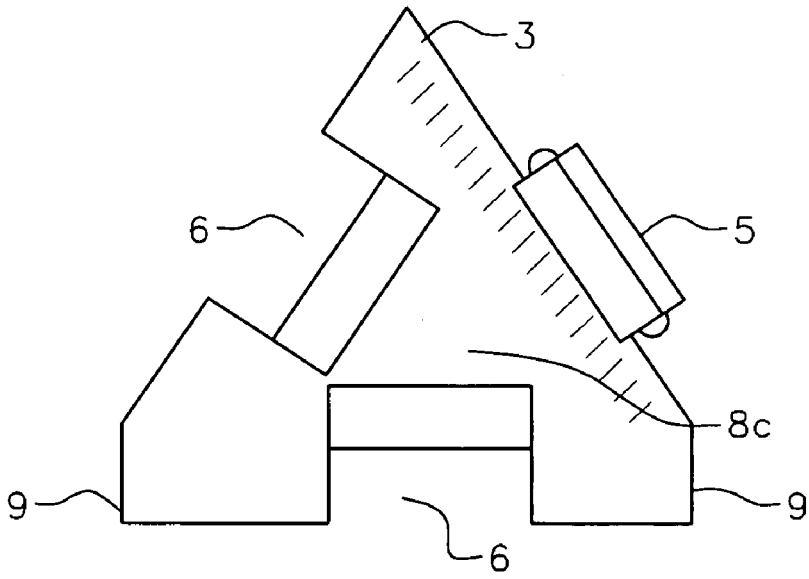
FIG. 3*b* shows a top view of member C in secondary form for the present invention.

Then in FIG. 3*b*, Member C has a secondary form 8*c* shown by two indents 6 on two sides of a generally equilateral triangle. On the remaining side, Member C has one positioner 5, typical of a secondary form 8*c*. The indents 6 and positioner 5 are generally centered upon their sides. Two corners of Member C have an offset 9 in the secondary form 8, and the offsets 9 flank an indent 6 that is opposite the included angle 3 of 67.5°. As before, the side of Member C with a positioner 5 has a pointed bevel to engage other positioners 5 and the sides with an indent 6 have a rounded edge. The included angle 3 and offset 9 corners of Member C in primary 7*c* and secondary 8*c* forms permit the assembly of a sphere 11 as later described.

Figure 4A:
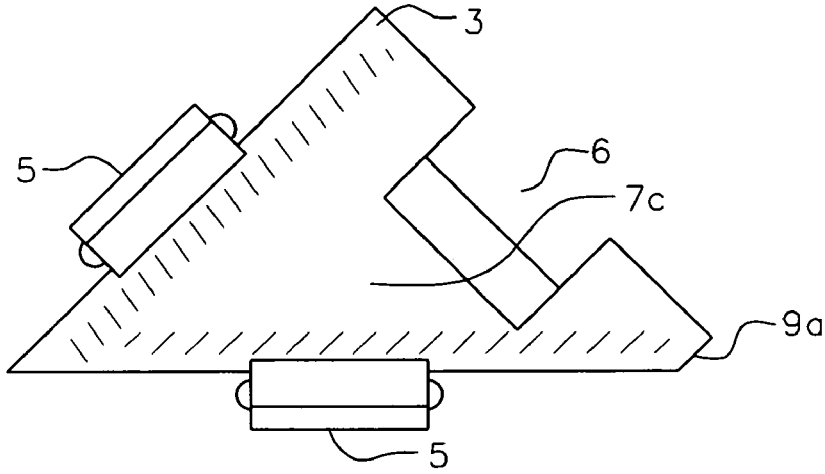
FIG. 4*a* shows a top view of member D in primary form for the present invention.

FIG. 4*a* shows the primary form. 7*d* of Member D as a right triangle with two positioners 5 and one indent 6. More particularly, Member D has two sides with the same effective length that form the included angle of 90°. The sides flanking the right angle connect with all sides of Members B and C and with the short side of Member A. The side opposite the right angle connects with the long sides of Member A. The effective length arises upon blunting one corner 9*a* located opposite the right angle and on the same side as the indent 6. As before, the sides of Member D with a positioner 5 have a pointed bevel that engages other positioners 5 and the side with an indent 6 has a rounded edge.

Figure 4B:
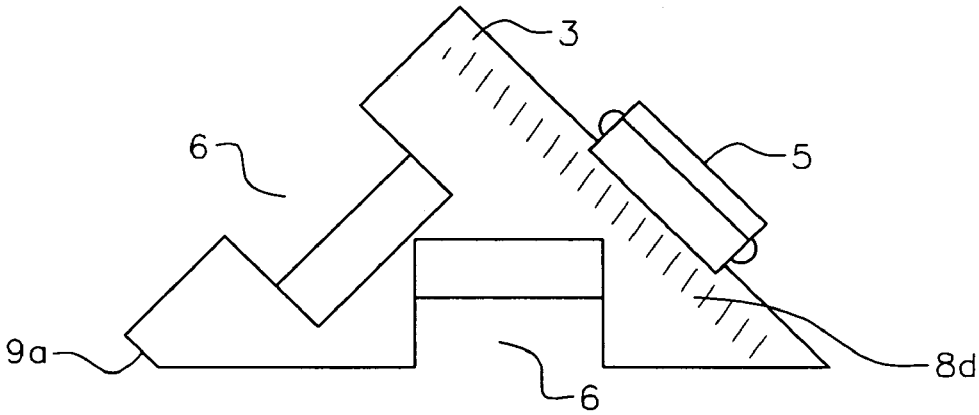
FIG. 4*b* shows a top view of member D in secondary form for the present invention.

Then in FIG. 4*b*, Member D has a secondary form 8*d* shown by one positioner 5 and two indents 6 upon a right triangle: one indent 6 upon the hypotenuse and the other indent 6 upon the side with a blunted corner 9*a*. The blunted corner 9*a*, opposite the positioner 5, makes both sides have the same effective length. The indents 6 and positioner 5 are generally centered upon their sides. As before, the side of Member D secondary form 8*d* with a positioner 5 has a pointed bevel that engages other positioners 5 and the sides with an indent 6 have a rounded edge. The included angle 3 and single truncated corners 9*a* of Member D in primary 7*d* and secondary 8*d* forms permit the assembly of a square, cube 10, then rectangle as later described.

Figure 5A:
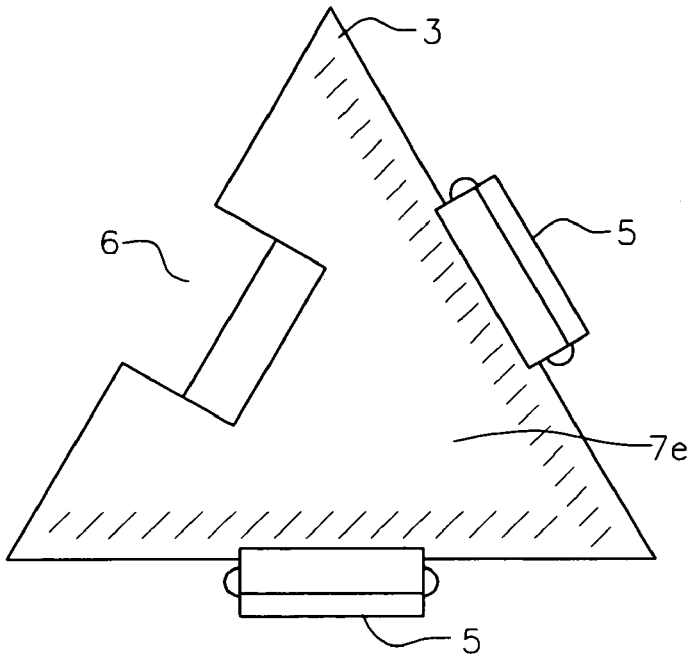
FIG. 5*a* shows a top view of member E in primary form for the present invention.

In FIG. 5*a*, the primary form 7*e* of Member E appears as a generally equilateral triangle with two positioners 5. The sides of the primary form 7*e* have the same length here. Member E has an included angle 3 of 60°. Upon two sides, Member E has a centered positioner 5 and on the remaining side Member E has a centered indent 6. As in other primary forms, this primary form 7*e* has a positioner 5 opposite the included angle 3. The sides of Member E with a positioner 5 have a pointed bevel that engages another positioner 5, the remaining side is rounded over, and the corners of Member E have a dulled point. However, the sides in primary form 7*e* have greater length than the primary form 7*b*. The sides of Member E have the same length and connect with the sides flanking the included angle 3 of Members 7*a*, 7*b*, and the side opposite the included angle 3, or hypotenuse of Member 7*c*, 8*c*.

Figure 5B:
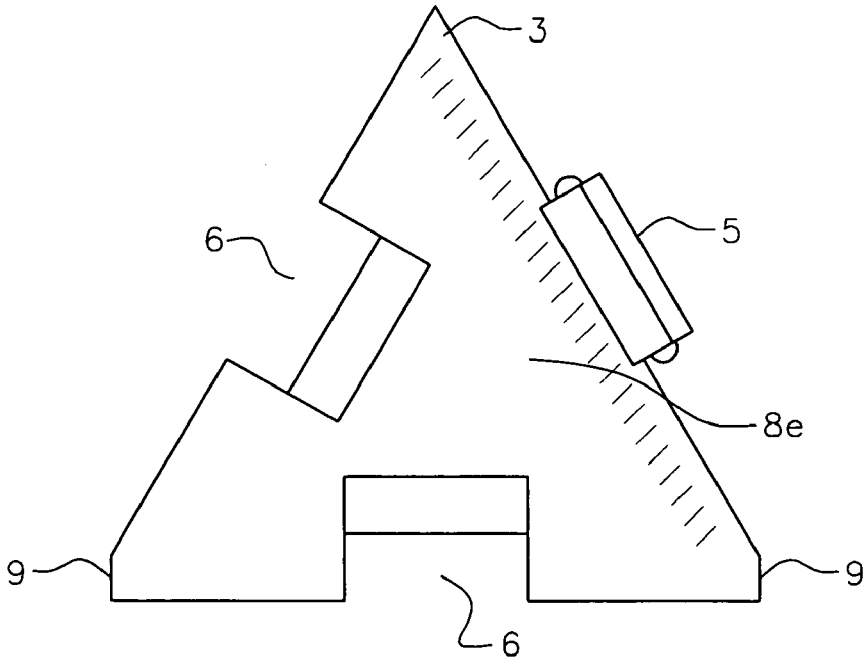
FIG. 5*b* shows a top view of member E in secondary form for the present invention.

Then in FIG. 5*b*, Member E has a secondary form 8*e* shown by two indents 6 on two sides of a generally equilateral triangle. On the remaining side, Member E has one positioner 5, typical of a secondary form 8. The indents 6 and positioner 5 are centered upon their sides with one indent located opposite the included angle 3. Two corners of Member E have an offset 9 in the secondary form 8, one corner opposite the positioner 5 and the other corner adjacent to the positioner 5. The side with a positioner 5 has a pointed bevel and the remaining sides are rounded over. However, the sides in secondary form 8*e* have greater length than the primary form 8*b*. The sides of Member E have the same length and connect with the sides flanking the included angle 3 of Members 7*a*, 7*b*, and the side opposite the included angle 3, or hypotenuse of Member 7*c*, 8*c*.

Figure 6A:
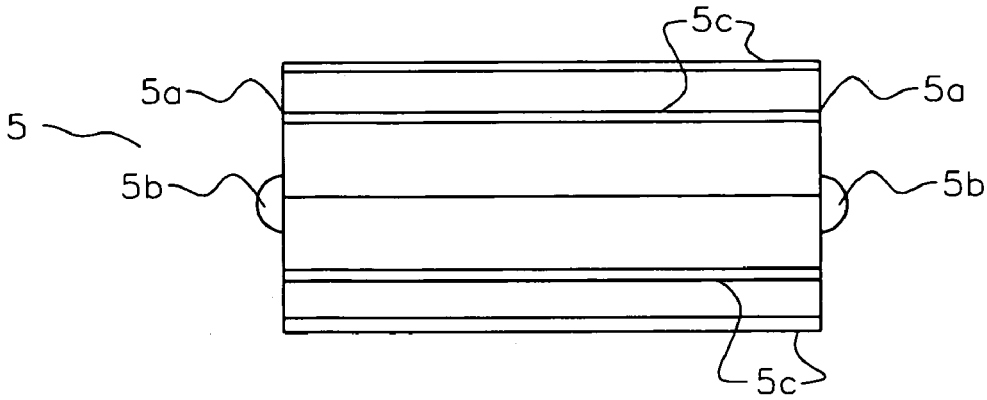
FIG. 6*a* illustrates a side view of a positioner attached to a member with the longitudinal axis of the positioner coplanar with the member in the preferred embodiment of the puzzle.

Taking a detailed view of a positioner 5, FIG. 6*a* shows a typical positioner 5 installed upon a piece 1 on a pointed bevel side. The positioner 5 has a generally rectangular form and four spokes 5*c*. The longitudinal axis of the positioner 5 is centered upon the side of piece 1 and parallel to the plane of a piece 1. The spokes 5*c* extend radially from the longitudinal axis of the positioner 5. Upon each end 5*a*, the positioner 5 has a centered nub 5*b*, preferably a hemisphere.

Figure 6B:
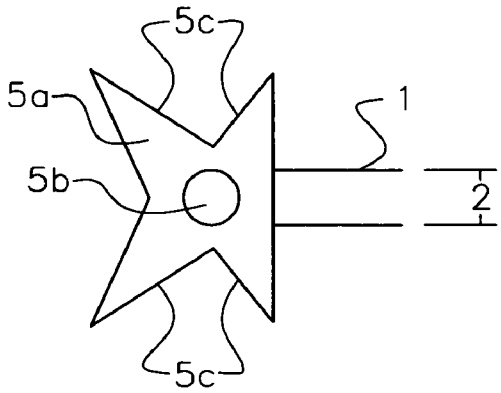
FIG. 6*b* describes an end exploded view of a positioner and adjacent member.
Figure 6C:
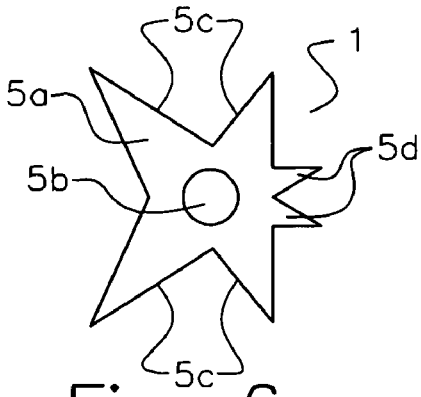
FIG. 6*c* describes an end exploded view of another embodiment of the positioner and adjacent member.

The spokes 5*c* have a symmetric form with right angles upon the sides and a central angle between the right angles as shown in FIG. 6*b*. Opposite the spokes 5*c*, the positioner 5 has two fingers 5*d* at an angle that mates with the pointed bevel of a piece 1. In the preferred embodiment shown in FIG. 6*c*, the fingers 5*d* make an included angle of 44°. The fingers 5*d* secure the positioner 5 to a piece 1.

Figure 7:
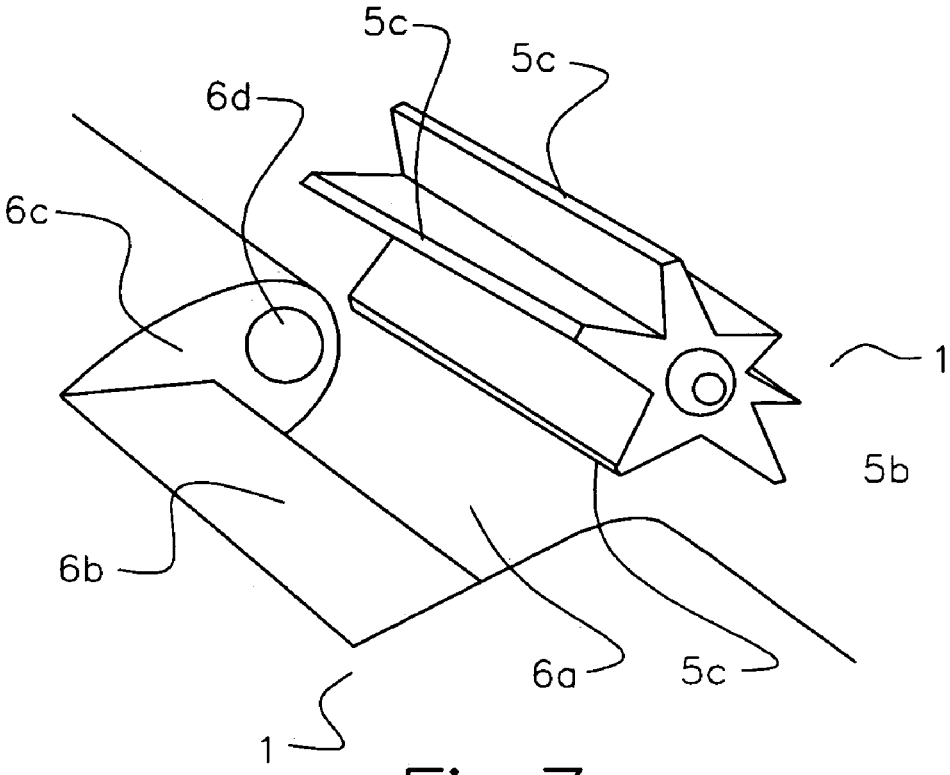
FIG. 7 describes a positioner of one member engaging an indent of a second member to build a shape using the present invention.

Moving to FIG. 7, an exploded view shows the connection of a positioner 5 to an indent 6. An indent 6 has a generally rectangular shape in top view with the longitudinal axis of the indent 6 parallel to the edge of a piece 1. The thickness 2 of the piece is removed for slightly over half the depth 6*a* of the indent 6 along the lateral axis away from the edge. Within the indent 6, the piece 1 then resumes as a tooth 6*b* formed from two intersecting edges. The edges run from the tip of the tooth 6*b* back to the top and bottom surfaces of a piece 1. The edges form the tooth 6*b* into an angle, preferably 38°. The indent 6 then engages the positioner 5 by locating the tooth 6*b* between two spokes 5*c*.

The spokes 5*c* of one piece 1 allow the indent 6 of a second piece 1 three angles of attachment to construct shapes. To secure a tooth 6*b* at an angle and one piece 1 to another, the indent 6 has two depressions 6*d* upon the lateral axis of the indent 6. The depressions 6*d* are located near the edge of the indented piece. Upon inserting a positioner 5 into an indent 6, the nubs 5*b* of the positioner 5 engage the depressions 6*d*. The nubs 5*b*, in cooperation with the tooth 6*b* and spokes 5*c*, secure a positioner 5 into an indent 6 at a selected angle.

In the preferred embodiment, the positioners 5 and indents 6 located upon Members A, B, C, D, and E have the same sizes respectively. The positioners 5 of one member 1 connect with the indents 6 of another member on a side of the same effective length. The offset 9 of adjacent pieces 1 is the same as the thickness of a piece 1.

Figure 8:
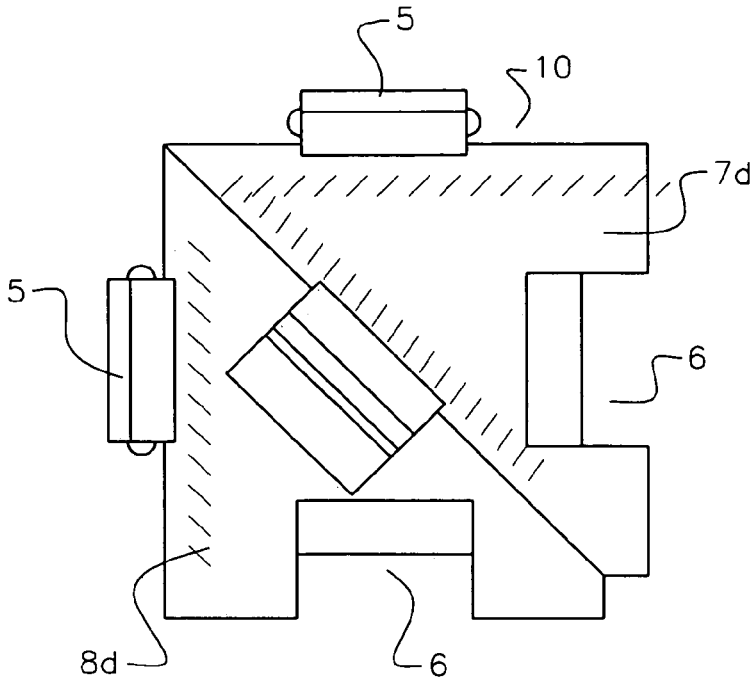
FIG. 8 describes a the formation of two member D into a square as the foundation for cube and box shapes using the present invention.
Figure 9:
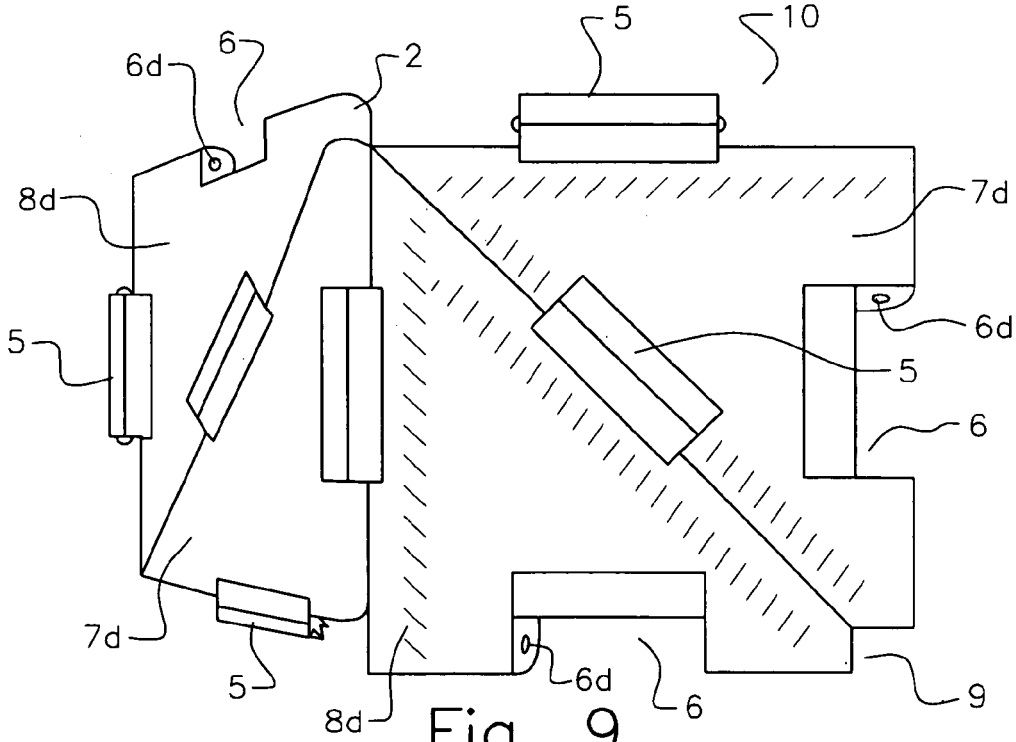
FIG. 9 shows a corner of a cube or box shape assembled by formations of member D using the present invention.

The aforementioned pieces assemble into a variety of shapes. The shapes start from basic forms that a person combines into a desired shape or sculpture. The pieces 1 assemble as a person matches sides of equal length upon adjacent pieces. A person connects the spokes 5*c* of a positioner 5 of one piece to the indent 6 of an adjacent piece. FIG. 8 shows a square assembled from a primary 7*d* and a secondary 8*d* member D connected upon their hypotenuses. The positioner 5 of the primary Member 7*d* engages the insert 6 upon the hypotenuse of the secondary Member D. This square though has additional features for assembling into larger shapes. Upon the corner between two positioners 5, the corner is tight and square. Upon the corner between two inserts, the corner has an offset 9. The offset 9 has a length on each side approximately that of the thickness 2 of primary Member 7*d*. The offset 9 extends two sides of the square slightly to permit fitting of adjacent squares into cubes and boxes as in FIG. 9. The offset 9 applies to the primary 7 and secondary 8 forms of each Member. The primary form 7 establishes the lengths of the sides of each Member. Opposite the included angle, the secondary form 8 has an adjustment in length, or offset 9, to separate the primary form 7 in connection with the secondary form 8 of each Member. Connecting primary forms 7 of Members to secondary forms 8 of Members in an alternating manner provides a strong fit for adjacent Members 1.

The other two corners of the square are the right angles of the primary 7*d* and secondary 8*d* member. The offset 9 shown on one corner locates adjacent squares so that positioners 5 alternate with indents 6 and that one square fits next to another square within the same distance measured from the spoke 5*c* of one positioner 5 to the edge of the opposite side. This distance is repeated on all faces of a cube 10 or box. Further, the sides of the square connect with the sides of Members A, B, and C. A person uses their imagination in connecting Members A, B, and C to a square formed of Member D forming a variety of shapes.

Figure 10:
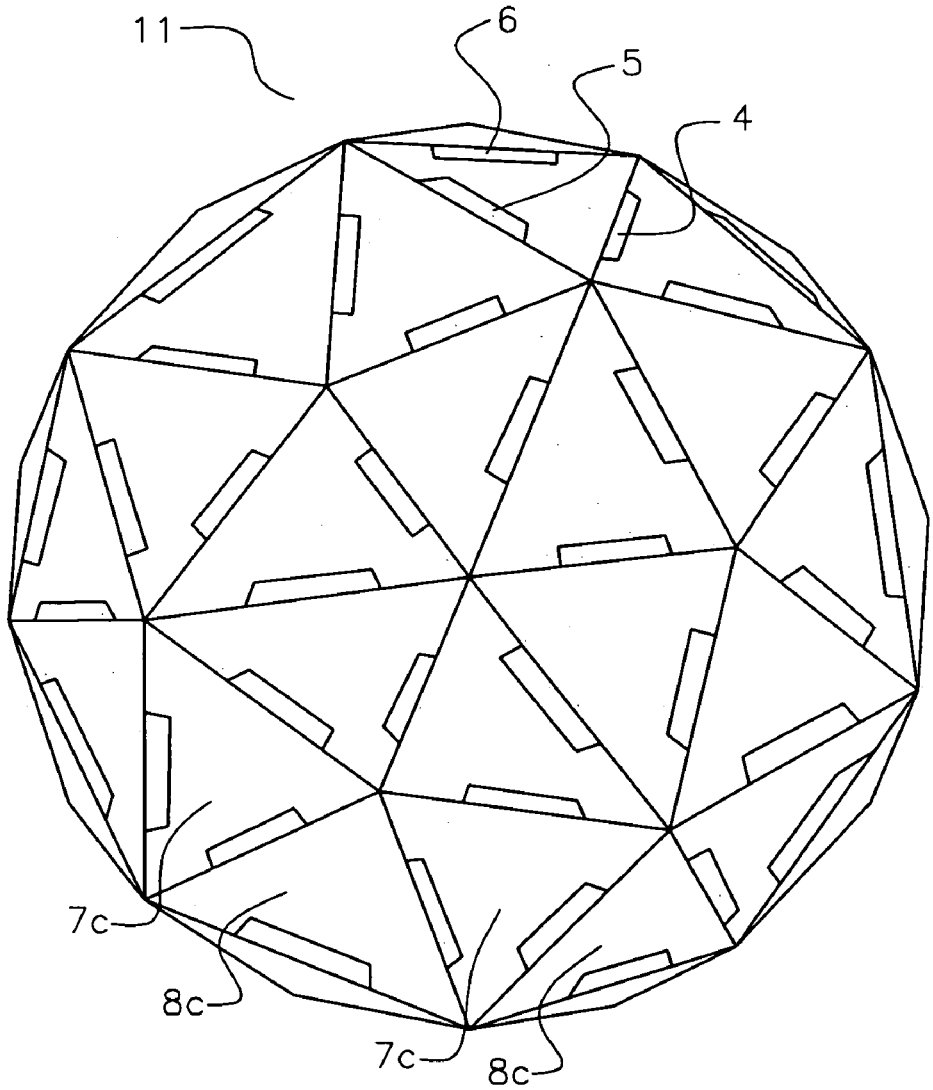
FIG. 10 illustrates the formation of a sphere or spherical shape.

Beyond a cube 10, other pieces assemble into a sphere 11 as shown in FIG. 10. The pieces form the surface of the sphere 11 at a sufficient diameter to maintain the sphere 11 without external support. A sphere 11 assembles from the combination of two panels, pentagon and hexagon in shape. Each shape occupies a plane of 360°. At each intersection of two pieces, the sphere 11 drops at the angle of decent. The angle of decent defines the slope of any one piece assembled into the surface of the sphere 11. Solving three equations provides the angle of decent, or x:

$(360-2x)\div 5\equiv y$ provides the included angle between two sides of a pentagon in a sphere;

$(360-2x)\div 6\equiv z$ provides the included angle between two sides of a hexagon in a sphere; and, $(180-y)\div 2\equiv z$ provides the relation between the included angles of hexagons and pentagons upon a sphere.

The solution to these equations has an angle of decent, x, of 11.25°, a pentagon included angle of 67.5°, and an hexagon included angle of 56.25°. A piece 1 having both of those angles can assemble a spherical shell. Member 7*c*, 8*c* has an included angle of 67.5° and a hexagon included angle of 56.25°. Assembling primary 7*c* and secondary 8*c* members in an alternating fashion builds a spherical shell as shown in FIG. 10. As in FIG. 9, the alternating Members 7*c*, 8*c* have an offset 9 between adjacent pieces 1 that permits a proper fit.

In the preferred embodiment, the pieces 1 have a size suitable for a puzzle, toy, or game. At this size, the positioners 5 and indents 6 are centered on member E and generally centered on members A, B, C, D. However, the present invention may have larger dimensions if constructed for use as housing or other structures. At larger lengths of sides, the present invention calls for multiple postioners 5 and matching indents 6 for a tight joint of adjacent pieces 1. The multiple positioners 5 can be spaced regularly or irregularly along a side as needed to support the length of the side of a piece within a structure.

From the aforementioned description, a polyhedral puzzle has been described. The polyhedral puzzle is uniquely capable of assembling near spherical and cubic shapes, and combining spherical and cubic forms for sculpture of people and other forms. The polyhedral puzzle and its various components may be manufactured from many materials, including but not limited to, woods of many kinds, polyvinyl chloride PVC, polymers, high density polyethylene HDPE, polypropylene PP, nylon, ferrous and non-ferrous Metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A structure, that assembles into a polyhedron or a combination with another shape, comprising:

a plurality of members, said members connecting in an alternating manner, and said members having a thickness, a generally triangular shape with an included angle, and a plurality of means to connect said members;

said connecting means having a positioner upon one member and an indent that receives said positioner upon another member;

said positioner having a generally rectangular shape with two lateral ends and a nub upon each lateral end, two or more spokes extending longitudinally upon said positioner and two fingers opposite said spokes, said fingers binding said positioner onto one of said members; and, said indent having a generally rectangular shape with a width to receive the longitudinal axis of said positioner, said indent extending into said member as a recess and then forming a tooth, said tooth expanding as a wedge from a line to the thickness of said other member, and having upon each lateral end of said indent a depression to receive said nub of said positioner;

whereby, said positioner engages said indent by said indent receiving said spokes and said nubs.

2. The structure of claim 1 further comprising:

said members each having a primary form and a secondary form;

said primary form having an included angle, one or more positioners on the side opposite said included angle, one or more positioners on a side flanking the included angle and one or more indents on the remaining side of said member;

said secondary form having said included angle, one or more indents on the side opposite said included angle, one or more positioners on a side flanking the included angle and one or more indents on the remaining side of said member;

whereby, said members connect by alternating connection of said primary form to said secondary form as each of said positioners engage said indents.

3. The structure of claim 2 further comprising:

said secondary form having a recess upon the side opposite said included angle and said recess establishes an overlap between adjacent primary and secondary forms of said member;

whereby said members assemble into a rigid shape as said primary form alternates with said secondary form.

4. The structure of claim 1 further comprising:

said members having a first member with an included angle of 45°, a second member with an included angle of 60°, a third member with an included angle of 67.5°, and a fourth member with an included angle of 90°.

5. The structure of claim 4 where in said first member is an isosceles triangle, said second member is an equilateral triangle, and said fourth member is a right triangle.

6. The structure of claim 4 wherein said third member in said primary forms and said secondary forms assembles into a sphere.

7. The structure of claim 4 wherein said fourth member in said primary forms and said secondary forms assembles into a cube.

8. The structure of claim 1 wherein said primary form has one positioner on the side opposite said included angle, one positioner on a side flanking the included angle and one indent on the remaining side of said member; and, said secondary form has one indent on the side opposite said included angle, one positioner on a side flanking the included angle and one indent on the remaining side of said member.

9. The structure of claim 2 further comprising:

said members assembling into a building;

said primary form having two or more spaced positioners on the side opposite said included angle, two or more spaced positioners on a side flanking the included angle and two or more spaced indents on the remaining side of said member; and, said secondary form having two or more spaced indents on the side opposite said included angle that match said positioners of said primary form, two or more spaced positioners on a side flanking the included angle that match said indents of said primary form, and two or more indents on the remaining side of said member that match said positioners of said primary form.

* * * * *